US010845088B2

(12) United States Patent
Ono

(10) Patent No.: US 10,845,088 B2
(45) Date of Patent: Nov. 24, 2020

(54) TOTALLY AERATED COMBUSTION BURNER

(71) Applicant: RINNAI CORPORATION, Aichi (JP)

(72) Inventor: Takahiro Ono, Nagoya (JP)

(73) Assignee: RINNAI CORPORATION, Aichi (JP)

( * ) Notice: Subject to any disclaimer, the term of this patent is extended or adjusted under 35 U.S.C. 154(b) by 123 days.

(21) Appl. No.: 16/033,822

(22) Filed: Jul. 12, 2018

(65) Prior Publication Data

US 2019/0024941 A1 Jan. 24, 2019

(30) Foreign Application Priority Data

Jul. 18, 2017 (JP) ..... 2017-138842

(51) Int. Cl.

| | |
|---|---|
| ***F24H 1/14*** | (2006.01) |
| ***F28F 1/12*** | (2006.01) |
| ***F23D 14/14*** | (2006.01) |
| ***F23D 14/02*** | (2006.01) |
| *F23D 14/46* | (2006.01) |

(52) U.S. Cl.

CPC ..... *F24H 1/145* (2013.01); *F23D 14/02* (2013.01); *F23D 14/14* (2013.01); *F23D 14/145* (2013.01); *F28F 1/12* (2013.01); *F23D 14/46* (2013.01); *F23D 2203/103* (2013.01); *F23D 2900/00019* (2013.01)

(58) Field of Classification Search

CPC ..... F23D 14/02; F23D 14/14; F23D 14/145; F23D 14/46; F23D 2203/103; F23D 2900/00019; F24H 1/145; F28F 1/12

USPC ..... 122/18.4

See application file for complete search history.

(56) References Cited

U.S. PATENT DOCUMENTS 5,520,536 A * 5/1996 Rodgers ..... F23D 14/02 126/116 R

2014/0000534 A1* 1/2014 Naitoh ..... F24H 9/2035 122/14.21

FOREIGN PATENT DOCUMENTS

JP 2014-009839 A 1/2014

* cited by examiner

*Primary Examiner* — Steven B McAllister
*Assistant Examiner* — Benjamin W Johnson
(74) *Attorney, Agent, or Firm* — Cermak Nakajima & McGowan LLP; Tomoko Nakajima

(57) ABSTRACT

A totally aerated combustion burner has: a burner body which is supplied therein with air-fuel mixture; and a combustion plate part which covers an open surface of the burner body. The combustion plate part is constituted by: a burner frame in a shape of a picture frame; a metal-fiber knit which is disposed to cover, from a burner-body side, an opening enclosed by the burner frame; and a distribution plate which has formed therein a multiplicity of distribution holes and which sandwiches the metal-fiber knit between the burner frame and the distribution plate. Only the metal-fiber knit is spot-welded to that opening peripheral part of the burner frame which is positioned on a same surface as the opening. The distribution plate is spot-welded to that portion of the burner frame which is offset from the opening peripheral part toward the burner-body side.

2 Claims, 8 Drawing Sheets

TOTALLY AERATED COMBUSTION BURNER

TECHNICAL FIELD

The present invention relates to a totally aerated combustion burner (also called "all primary air burner") which is provided with: a burner body which is supplied therein with air-fuel mixture; and a combustion plate part which covers an open surface of the burner body.

BACKGROUND ART

Conventionally, in this kind of totally aerated combustion burner, there is known an art in which a combustion plate part is constituted by: a burner frame in a shape of a picture frame; a metal-fiber knit (i.e., a metal knit formed of a heat resistant metal fiber) which is disposed to cover, from a burner-body side, an opening enclosed by the burner frame; and a distribution plate which has formed therein a multiplicity of distribution holes and which sandwiches the metal-fiber knit between the burner frame and the distribution plate. The air-fuel mixture supplied to the inside of the burner body is arranged to be ejected through the distribution holes and the metal-fiber knit (see, for example, JP-A-2014-9839). In this arrangement, on the opening peripheral part of the burner frame which is positioned on the same surface level as the opening, the metal-fiber knit and the distribution plate are spot-welded together.

If the metal-fiber knit and the distribution plate are spot-welded together, heat is likely to be transmitted from the metal-fiber knit to the distribution plate through the welded positions. In addition, since the metal-fiber knit will rise to a considerably elevated temperature during combustion, the distribution plate will also rise to an elevated temperature due to heat transmission through the welded positions, thereby causing high possibility of backfire.

SUMMARY

Technical Problem

In view of the above-mentioned points, this invention has a problem of providing a totally aerated combustion burner which is arranged to be able to restrain the heat transmission from the metal-fiber knit to the distribution plate.

Solution to Problem

In order to solve the above problem, this invention is a totally aerated combustion burner comprising: a burner body which is supplied therein with air-fuel mixture; and a combustion plate part which covers an open surface of the burner body. The combustion plate part is constituted by: a burner frame in a shape of a picture frame; a metal-fiber knit which is disposed to cover, from a burner-body side, an opening enclosed by the burner frame; and a distribution plate which has formed therein a multiplicity of distribution holes and which sandwiches the metal-fiber knit between the burner frame and the distribution plate. Only the metal-fiber knit is spot-welded to that opening peripheral part of the burner frame which is positioned on a same surface level as the opening, and the distribution plate is spot-welded to that portion of the burner frame which is offset from the opening peripheral part toward the burner-body side.

According to this invention, the distribution plate is spot-welded to that portion of the burner frame which is away from the opening peripheral part toward the burner-body side, heat transmission from the metal-fiber knit to the distribution plate will be restrained. As a consequence, the distribution plate will not be raised to such an elevated temperature, and backfire can effectively be prevented.

By the way, that portion of the burner frame to which the distribution plate is spot-welded may be a side-plate part which is bent from the opening peripheral part toward the burner-body side, or may be an outward-bent stepped part which is provided in a middle of a side-plate part which is bent from the opening peripheral part toward the burner-body side.

DESCRIPTION OF EMBODIMENTS

Figure 1:
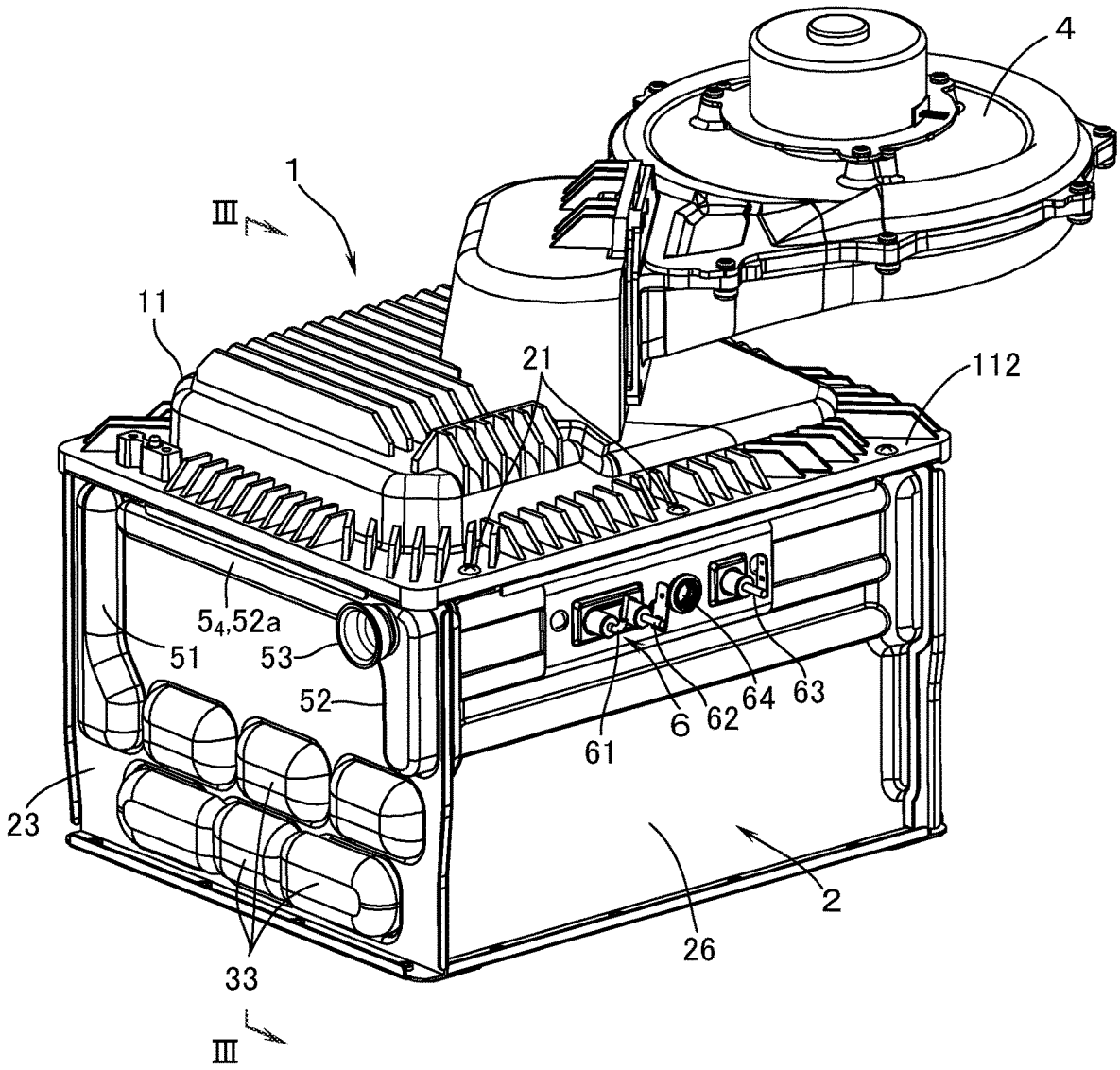
FIG. 1 is a perspective view of a combustion apparatus equipped with a totally aerated combustion burner according to an embodiment of this invention.

A combustion apparatus illustrated in FIG. 1 through FIG. 4 is provided with: a totally aerated combustion burner 1 having a burner body 11 which is supplied therein with air-fuel mixture (mixture gas of a fuel gas and primary air), and a combustion plate part 12 which covers a downward open surface 111 of the burner body 11; and a combustion box 2 having an upper end connection flange part 22 to be fastened with machine screws 21 to a body flange part 112 which encloses the open surface 111 of the burner body 11. The combustion box 2 has housed therein a heat exchanger 3 for supplying hot water.

The heat exchanger 3 is constituted by a fin-tube type of heat exchanger having: a multiplicity of fins 31; and a plurality of heat absorbing tubes 32 which penetrate through these fins 31. On outside surfaces of laterally one-side and the opposite-side side plates 23, 24 of the combustion box 2, there are mounted a plurality of connection covers 33 which define, together with each of the side plates 23, 24, connection passages for the adjoining two heat absorbing tubes 32, 32. All of the heat absorbing tubes 32 are thus connected in series with each other. In addition, a water inlet port 34 is disposed in the connection covers 33 which define, between the laterally opposite-side side plate 24, a connection passage to be connected to an upstream-end heat-absorbing tube 32.

Figure 2:
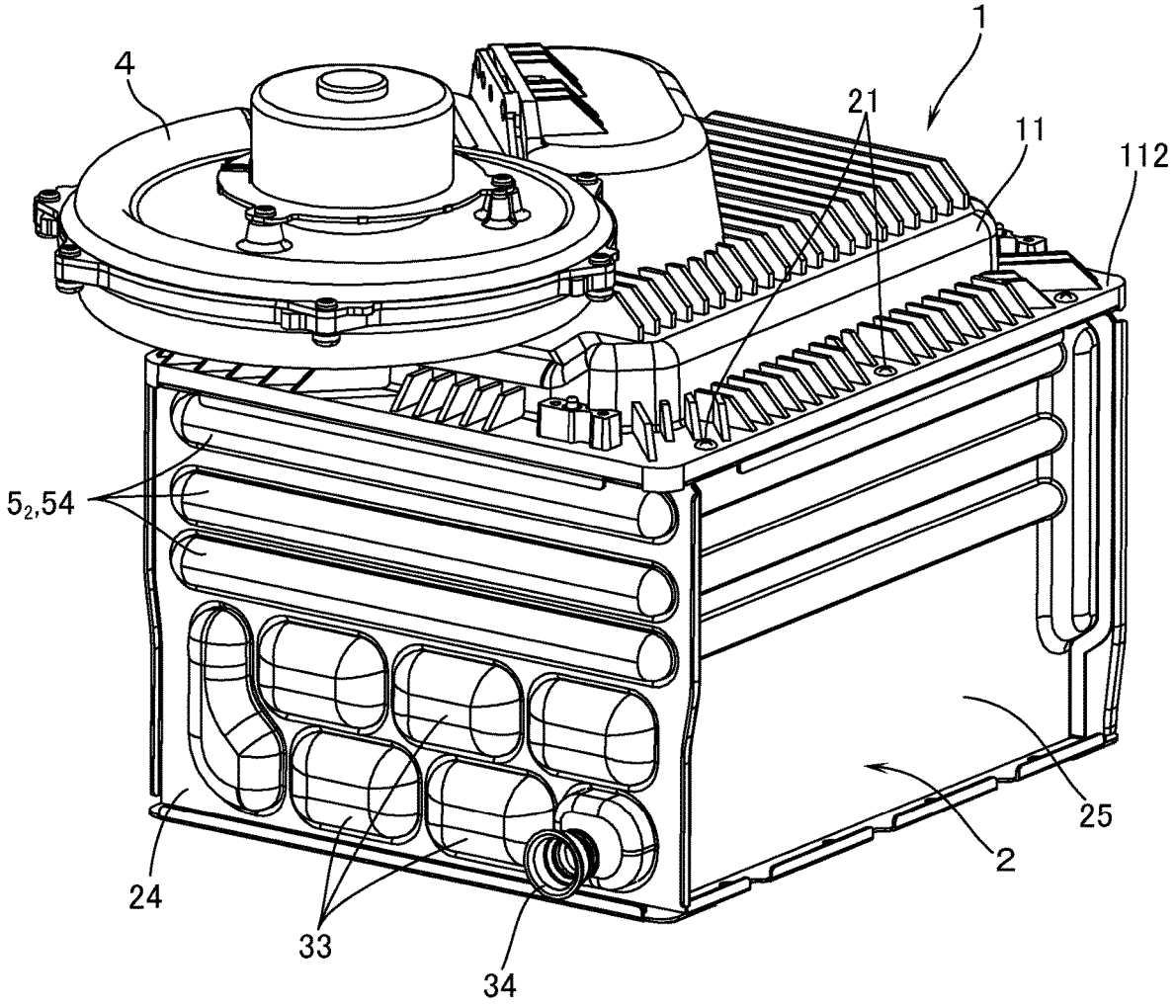
FIG. 2 is a perspective view of the combustion apparatus as viewed from a side opposite to that in FIG. 1.
Figure 3:
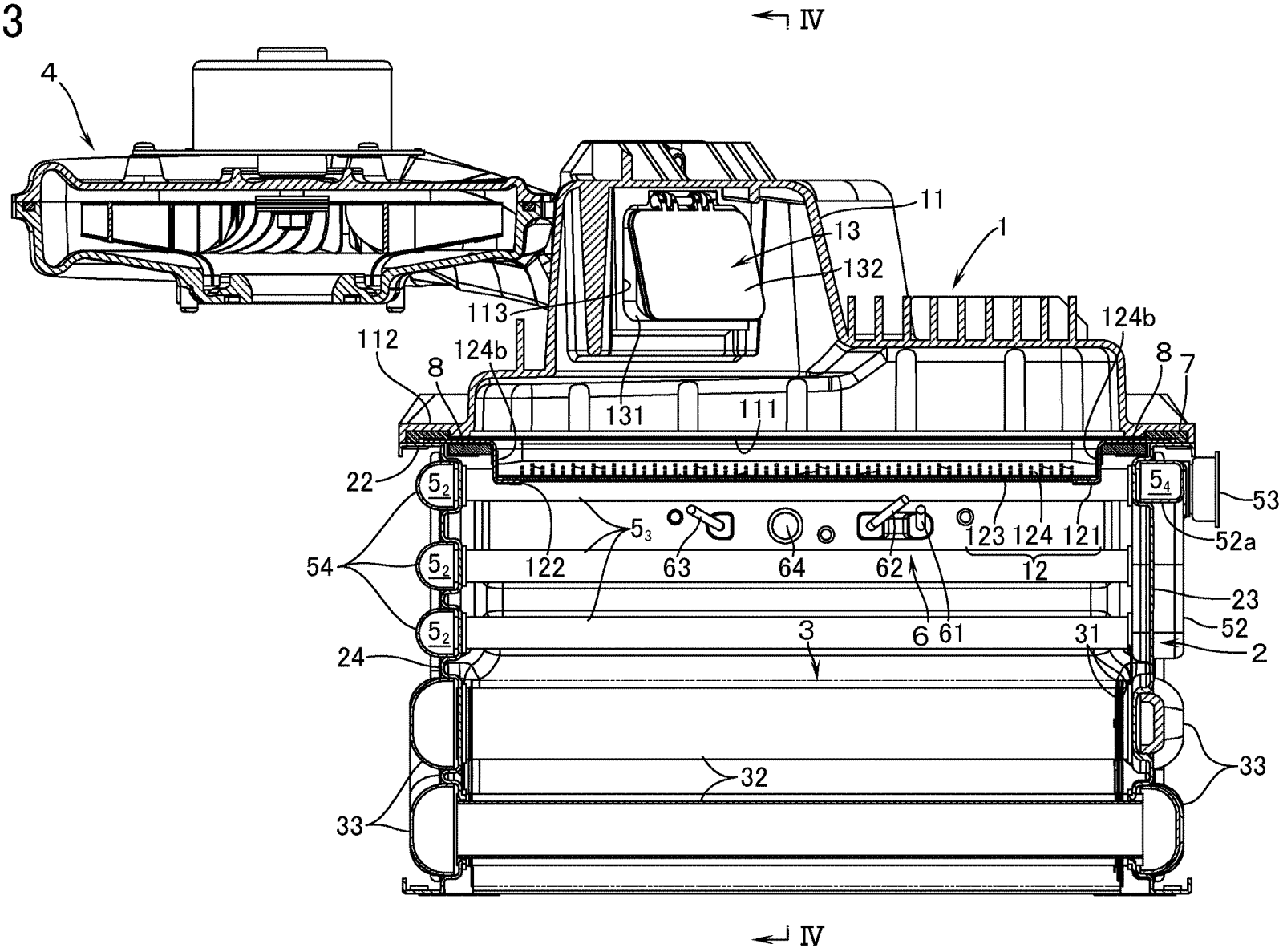
FIG. 3 is a sectional view cut away along the line III-III in FIG. 1.
Figure 4:
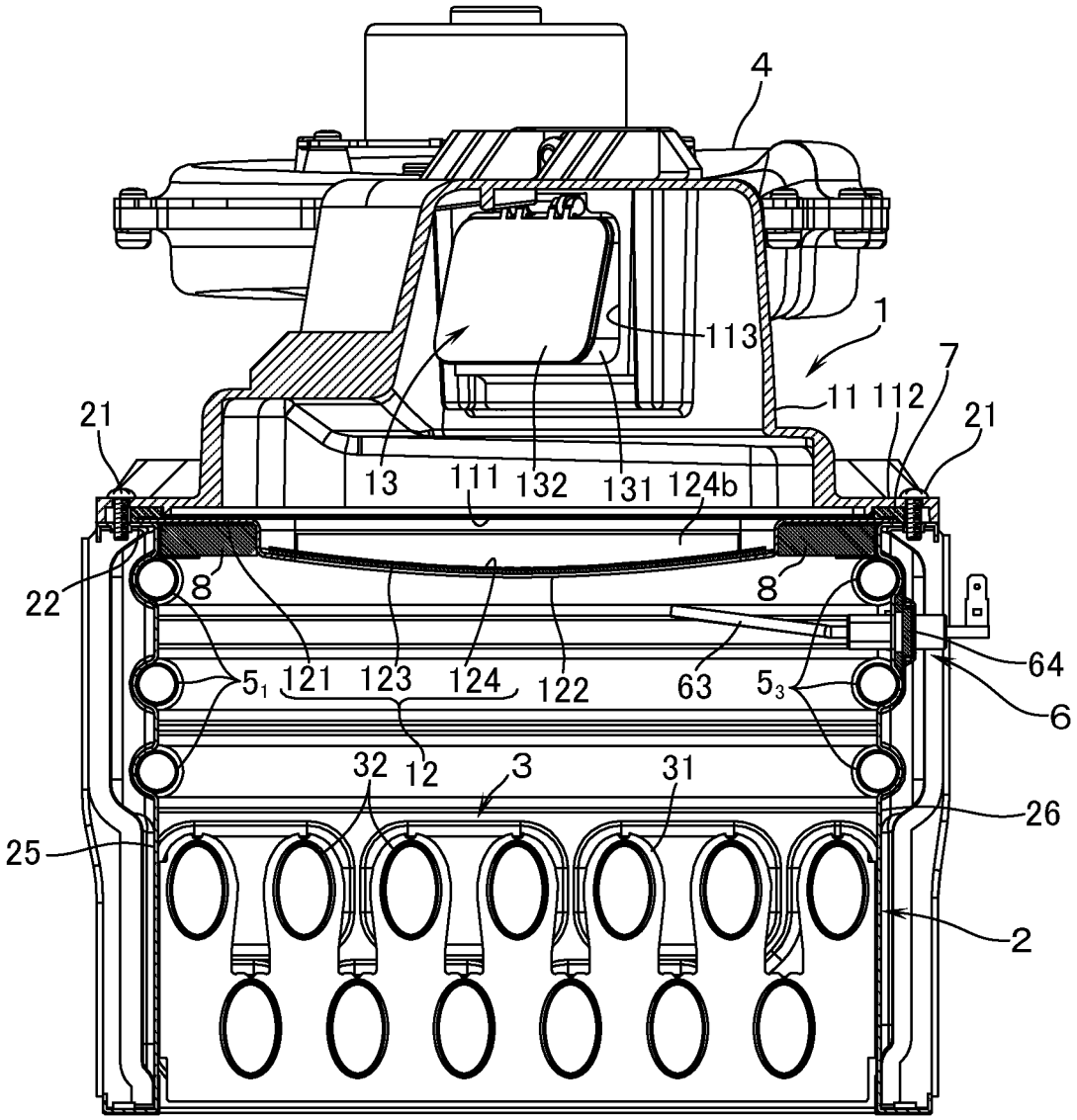
FIG. 4 is a sectional view cut away along the line IV-IV in FIG. 3.

Further, on an inside of that portion of the rear-side side plate 25 of the combustion box 2 which is above the heat exchanger 3, there are respectively vertically arranged three pieces of first water passages $\mathbf{5}_1$, made of tubes, in a manner to be in contact with the side plate 25. Also on an inside of that portion of the front-side side plate 26 of the combustion box 2 which is above the heat exchanger 3, there are respectively vertically arranged three pieces of third water passages $5_3$, made of tubes, in a manner to be in contact with the side plate 26. Further, on an outside surface of the laterally one-side side plate 23 of the combustion box 2, there are mounted: an inlet-side header cover 51 which defines, together with the side plate 23, a connection passage between the vertically arranged three pieces of first water passages $5_1$ and the downstream-end heat absorbing tube 32 of the heat exchanger 3; and an outlet-side header cover 52 which defines, together with the side plate 23, a connection passage for the vertically arranged three pieces of third water passages $5_3$. The outlet-side header cover 52 is provided with a hot water outlet port 53. The laterally opposite-side side plate 24 of the combustion box 2 is provided, as shown in FIG. 2 and FIG. 3, with three pieces of second water passages $5_2$ which connect together the three pieces of first water passages $5_1$ and the three pieces of third water passages $5_3$. Each of the second water passages $5_2$ is constituted by dents formed in the side plate 24 so as to be dented laterally inward, and a cover 54 mounted on an outside surface of the side plate 24 so as to cover the dents. Then, water supplied from the water inlet port 34 is heated by the heat exchanger 3 and the heated water is flowed out from the hot water outlet port 53 through the connection passages inside the inlet-side header cover 51, the first water passages $5_1$, the second water passages $5_2$, the third water passages $5_3$, and the connection passage inside the outlet-side header cover 52. Further, the laterally one-side side plate 23 of the combustion box 2 is provided with a fourth water passage $5_4$ which is extended rearward from an upper part of the connection passage inside the outlet-side header cover 52 and which is constituted by a laterally inward dent formed in the side plate 23 and a cover 52*a* integral with the outlet-side header cover 52 which covers the dent. Then, by means of the water to flow through the first through the fourth water passages $5_1$~$5_4$, each of the side plates 23~26 is arranged to be cooled.

The front-side side plate 26 of the combustion box 2 has mounted thereon an electrode component 6 having an ignition electrode 61, a ground electrode 62, and a flame rod 63, all penetrating the side plate portions between No. 1 and No. 2, i.e., totally two, third water passages $5_3$, $5_3$ counted from the top to thereby protrude into the combustion box 2. By the way, the electrode component 6 is additionally provided with an inspection window 64 which enables visual confirmation inside the combustion box 2.

Detailed description will now be made of a totally aerated combustion burner 1. The burner body 11 has opened therein an inlet port 113 to which is connected a fan 4 for supplying the air-fuel mixture. The inlet port 113 has mounted therein a check valve 13 which prevents, at the time of stopping of the fan 4, the air-fuel mixture staying inside the burner body 11 from flowing back toward the fan 4. The check valve 13 is constituted by: a resin valve box 131 to be fitted into the inlet port 113; and a resin valve plate 132 mounted in that opening of the valve box 131 which faces inside the burner body 11 so as to be swingable about an axis between opened and closed postures.

Figure 5:
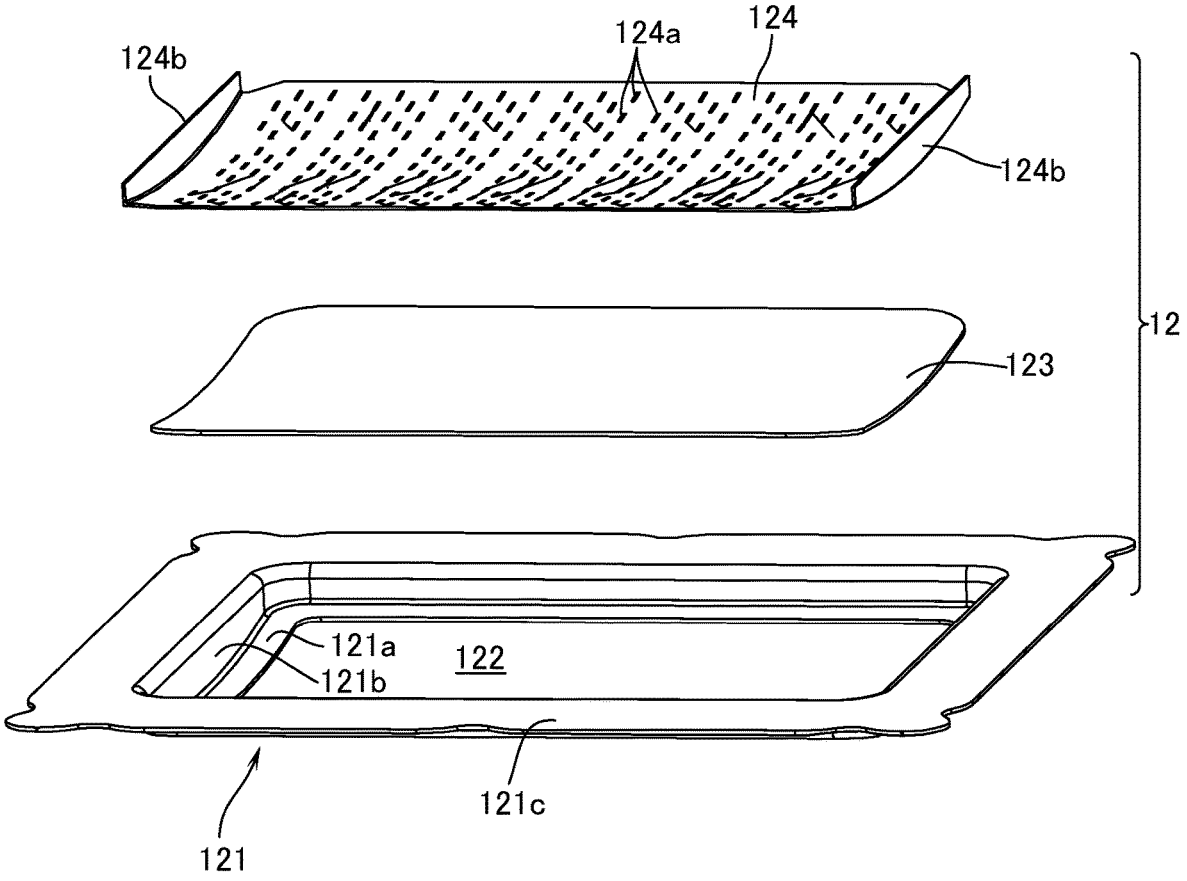
FIG. 5 is an exploded perspective view of a combustion plate part of the totally aerated combustion burner according to an embodiment of this invention.
Figure 6:
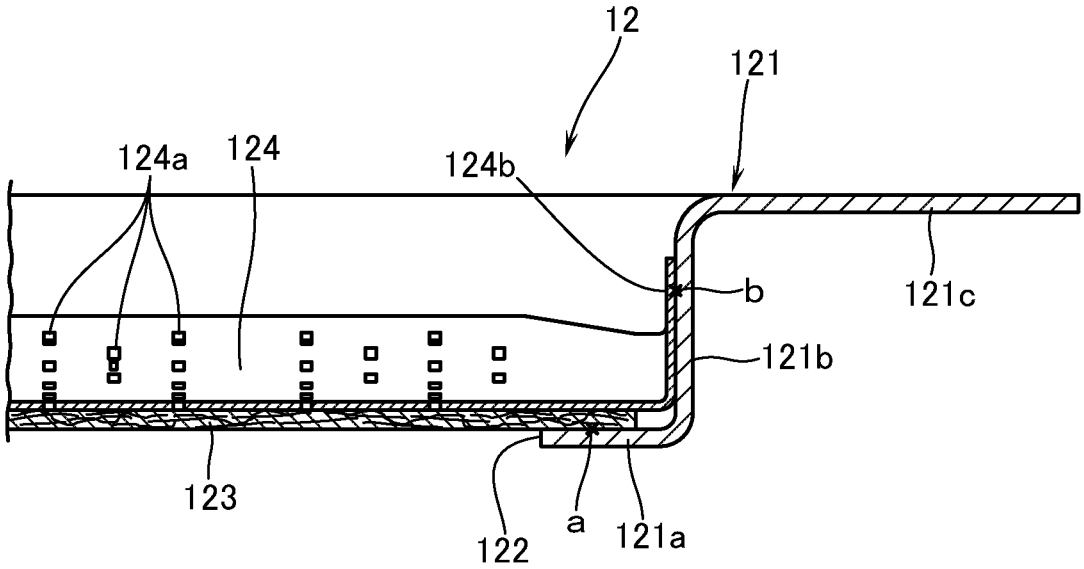
FIG. 6 is a sectional view of an essential part in an assembled state of the combustion plate part in FIG. 5.

With reference also to FIGS. 5 and 6, the combustion plate part 12 is constituted by: a burner frame 121 in the shape of a picture frame; a metal-fiber knit (i.e., textile knitted out of a metal fiber) 123 which is disposed so as to cover, from the burner-body 11 side (i.e., from an upper side), an opening 122 enclosed by the burner frame 121; and a distribution plate 124 which sandwiches the metal-fiber knit 123 between the distribution plate 124 and the burner frame 121 and which has formed therein a multiplicity of distribution holes 124*a*. The air-fuel mixture supplied to the inside of the burner body 11 is ejected, through the distribution holes 124*a* and the metal-fiber knit 123, out of the opening 122 to thereby perform totally aerated combustion (combustion requiring no secondary air). By the way, the opening 122 is curved into an arcuate shape in cross section in the front-to-back direction and, similarly, the metal-fiber knit 123 and the distribution plate 124 are also respectively curved into an arcuate shape in cross section in the front-to-back direction.

The burner frame 121 has: an opening peripheral part 121*a* which is positioned on the same surface level as the opening 122; a side plate part 121*b* which is bent from the opening peripheral part 121*a* to the burner-body 11 side (i.e., upward); and a frame flange part 121*c* which protrudes outward from an upper end of the side plate part 121*b*. Then, the frame flange part 121*c* is sandwiched between the body flange part 112 and the connection flange part 22. A packing 7 is further interposed between the frame flange part 121*c* and the body flange part 112, thereby securing the sealing characteristics. Further, a thermal insulation material 8 is attached to the lower surface of the frame flange part 121*c*.

The metal-fiber knit 123 is spot-welded to the opening peripheral part 121*a* at predetermined circumferential spacing in a state in which the peripheral part of the metal-fiber knit 123 is overlapped with an upper surface of the opening peripheral part 121*a* of the burner frame 121. In FIG. 6 an x-mark "a" indicates the position at which the metal-fiber knit 123 is spot-welded. The reason why the metal-fiber knit 123 is spot-welded to the opening peripheral part 121*a* is to prevent the metal-fiber knit 123 from getting loose due to expansion and contraction thereof.

By the way, it is conceivable to spot-weld the distribution plate 124 to the opening peripheral part 121*a* together with the metal-fiber knit 123. This idea, however, gives rise to the following disadvantage. In other words, since the heat is likely to be transmitted from the metal-fiber knit 123, through the welded points, to the distribution plate 124, the distribution plate 124 will rise to a considerably elevated temperature due to heat transmission from the metal-fiber knit 123 during combustion, thereby giving rise to backfire.

As a solution, in this embodiment, what is spot-welded to the opening peripheral part 121*a* is limited to the metal-fiber knit 123. Further, upward bent part 124*b* is formed by bending laterally both ends of the distribution plate 124. Then, the bent part 124*b* is spot-welded to the side plate part 121*b*, i.e., that portion of the burner frame 121 which is offset from the opening peripheral part 121*a* to the burner-body 11 side (i.e., to the upper side). In FIG. 6 an x-mark "b" indicates the position at which the bent part 124*b* is spot-welded. According to the above-mentioned arrangement, since the welding point of the distribution plate 124 is away from the welding point of the metal-fiber knit 123, the heat transmission from the metal-fiber knit 123 to the distribution plate 124 will be restrained. Therefore, the distribution plate 124 will not rise to such a considerably elevated temperature, thereby effectively preventing backfire from occurring.

Figure 7:
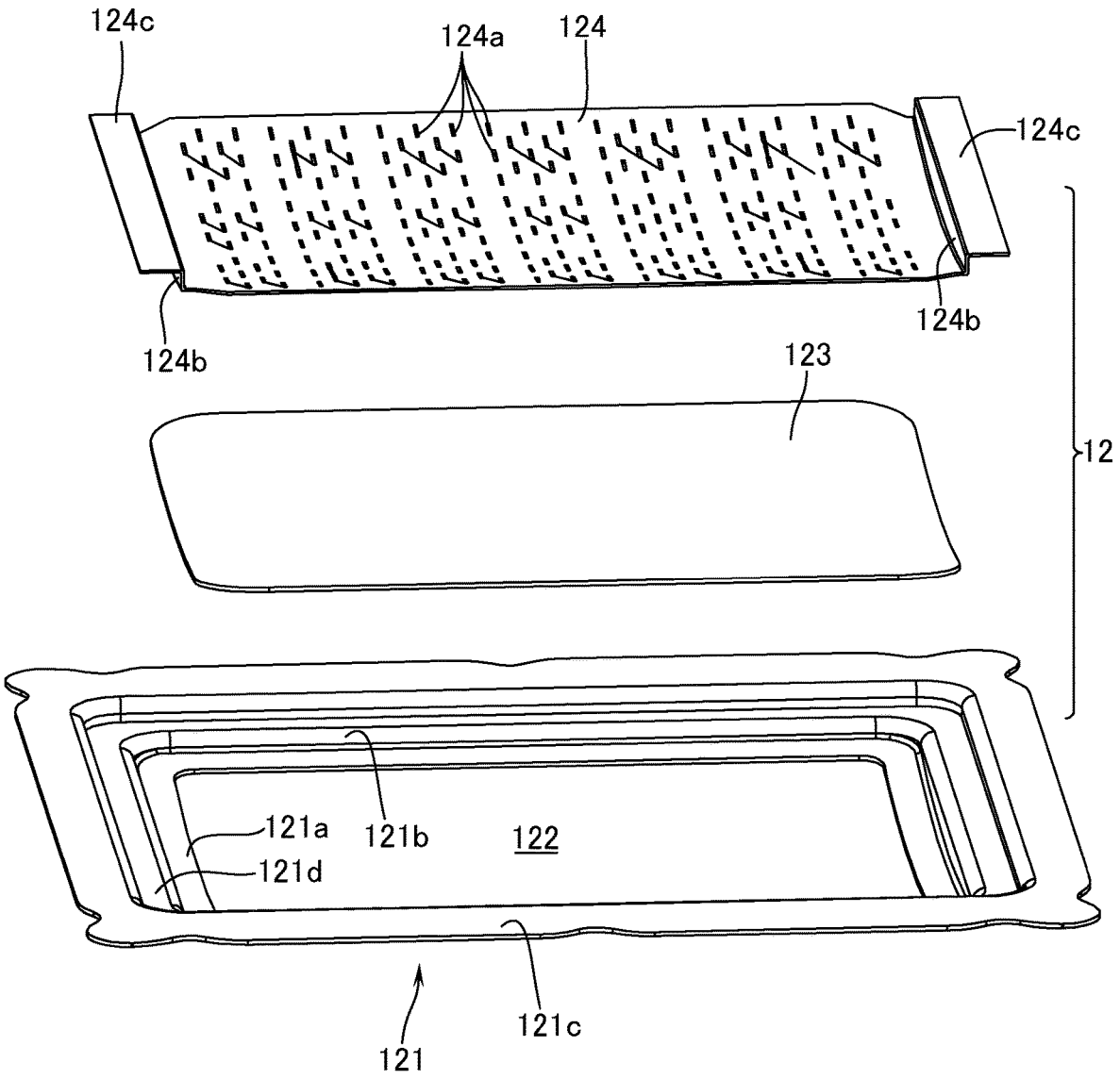
FIG. 7 is a perspective view in an exploded state of another embodiment of the combustion plate part.
Figure 8:
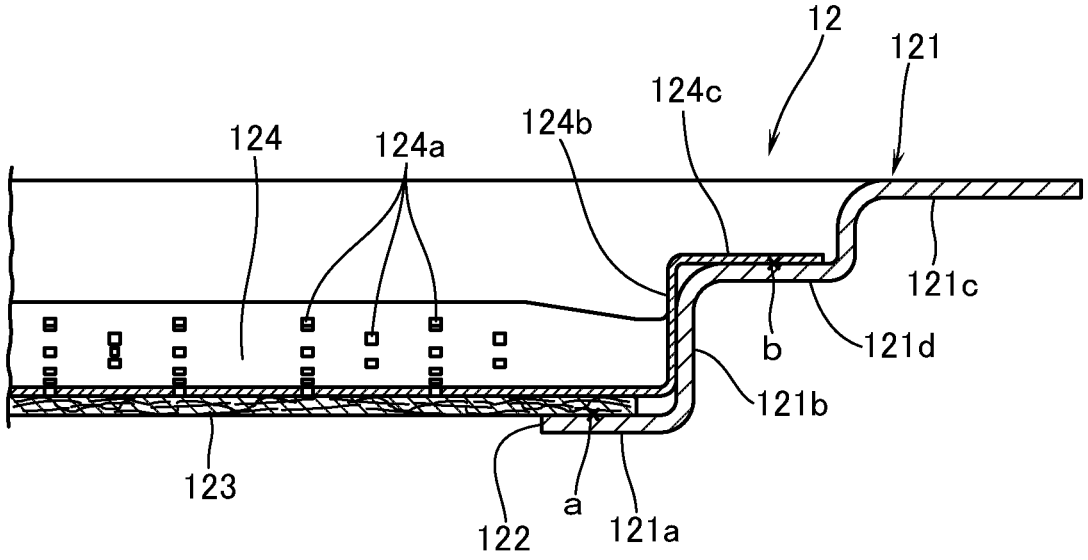
FIG. 8 is a sectional view of an essential part in an assembled state of the combustion plate part in FIG. 7.

Description will now be made of another embodiment of the combustion plate 12 with reference to FIGS. 7 and 8. In this embodiment, there is disposed an outward-bent stepped part 121*d* which is provided in a middle of the side-plate part 121*b* which is bent from the opening peripheral part 121*a* of the burner frame 121 toward the burner-body side (to the upper side). Further, at an upper end of the bent part 124*b* on laterally both ends of the distribution plate 124, there is disposed an outward-bent ear piece part 124*c*. Then, only the peripheral part of the metal-fiber knit 123 is spot-welded to the opening peripheral part 121*a* of the burner frame 121, and the ear piece part 124*c* of the distribution plate 124 is spot-welded to the stepped part 121*d* of the burner frame 121. According to this arrangement, too, the heat transmission from the metal-fiber knit 123 to the distribution plate 124 can similarly be restrained.

Descriptions have so far been made of embodiments of this invention with reference to the drawings. However, this invention shall not be limited to the above. For example, the totally aerated combustion burner of the above-mentioned embodiments has disposed the open surface 111 of the burner body 11 to look downward. This invention can also be applicable to a totally aerated combustion burner having disposed therein the open surface 11 to look upward.

REFERENCE SIGNS LIST

1 totally aerated combustion burner (all primary air burner)
11 burner body
111 open surface
12 combustion plate part
121 burner frame
121*a* opening peripheral part
121*b* side plate part
121*d* stepped part
122 opening
123 metal-fiber knit
124 distribution plate
124*a* distribution hole

What is claimed is:

1. A totally aerated combustion burner comprising:

a burner body which is supplied therein with air-fuel mixture; and a combustion plate part which covers an open surface of the burner body, the combustion plate part being constituted by:

a burner frame with a rectangular shape that comprises an opening peripheral part that is positioned on a same surface level as an opening enclosed by the burner frame, and a side plate part which is bent from the opening peripheral part to a burner body side, and a frame flange part which protrudes outward from an end of the side plate part;

a metal-fiber knit which is disposed to cover, from the burner-body side, the opening;

a distribution plate which has formed therein a multiplicity of distribution holes and which sandwiches the metal-fiber knit between the burner frame and the distribution plate, wherein only the metal-fiber knit is spot-welded to the opening peripheral part, and wherein the distribution plate is independently spot-welded to the side plate part via a portion of the distribution plate that is bent upwardly towards the burner body side.

2. The totally aerated combustion burner according to claim 1, wherein the side plate part includes a stepped part that is provided in a middle of the side plate part and has a horizontal surface, and the distribution plate is spot-welded to the horizontal surface of the stepped part.

* * * * *